US005079668A

United States Patent [19]

Maeshima

[11] Patent Number: 5,079,668

[45] Date of Patent: Jan. 7, 1992

[54] CORONA DISCHARGING DEVICE

[75] Inventor: Masanobu Maeshima, Sakai, Japan

[73] Assignee: Mita Industrial Co., Ltd., Osaka, Japan

[21] Appl. No.: 473,926

[22] Filed: Feb. 2, 1990

[30] Foreign Application Priority Data

Feb. 10, 1989 [JP] Japan ..... 1-15211[U]

[51] Int. Cl.[5] ..... G03G 15/02; H01T 19/04

[52] U.S. Cl. ..... 361/229; 355/255; 250/324

[58] Field of Search ..... 361/225, 229, 230, 231, 361/233, 424; 250/324–326; 355/221–226

[56] References Cited

U.S. PATENT DOCUMENTS 4,335,420 6/1982 Mitsuo et al. ..... 361/230
4,550,253 10/1985 Hashimoto ..... 250/326
4,603,964 8/1986 Swistak ..... 355/225
4,764,675 8/1988 Levy et al. ..... 250/324
4,792,680 12/1988 Lang et al. ..... 250/325

*Primary Examiner*—A. D. Pellinen
*Assistant Examiner*—David Osborn
*Attorney, Agent, or Firm*—Beveridge, DeGrandi & Weilacher

[57] ABSTRACT

A corona discharging device in which an engaging member engages with one of the slits of a control grid is provided on a cover of an end block. When mounting the control grid on the corona discharging device, one end of the control grid is first attached to the device, and the slit formed in the other end of the control grid engages with the engaging member on the cover. Subsequently, the cover is mounted on the end block with its one end serving as a fulcrum surface.

5 Claims, 3 Drawing Sheets

CORONA DISCHARGING DEVICE

BACKGROUND OF THE INVENTION

The present invention is directed to a corona discharging device for use with an image forming apparatus such as a copying machine or the like.

The image forming apparatus, such as a copying machine incorporates the corona discharging device for electrifying a photosensitive body. For the purpose of stabilizing an electrifying potential on the photosensitive body, there is provided a corona discharging device known as a so-called scorotron type in which a mesh-like grid plate, defined as a control grid is interposed between the photosensitive body and a corona wire. The grid plate is typically mounted on the corona discharging device and is so constructed as to be attachable to and detachable from the copying machine body together with the corona discharging device.

A long stretch of use of the corona discharging device, however, causes the adhesion of foreign matters to the corona wire or contamination of an interior of a shield case, which in turn requires periodic cleaning. On that occasion, an easier workload necessitates removal of the grid plate attached to the corona discharging device. The removed grid plate has to be, as a matter of course, remounted on the corona discharging device.

In order to facilitate the attachment and detachment of the grid plate with respect to the corona discharging device, a variety of proposals have hitherto been made. For instance, as disclosed in (1) Japanese Laid-Open Utility Model Publication No. 143961/1987, end blocks for holding the corona wire are fixedly provided at both ends of the corona discharging device, engaging members integrally standing erect on the end blocks. One of the engaging members is arranged to be elastically deformable, whereby the engaging members engage with slits conceived as engaged parts of the grid plate.

As is also disclosed in (2) Japanese Laid-Open Utility Model Publication No. 30268/1987, an engagement portion formed on a U-shaped spring member detachably mounted on a discharging body engages with one of the slits formed in the grid plate.

The first of the prior art corona discharging devices, however, presents the following problems. The grid plate is stretched with a tension by an elasticity of one of the engaging members, and hence a distance between the engaging members disposed at both ends of the corona discharging device in the longitudinal direction has to be longer than between the slits formed on both ends of the grid plate. As a result, when fitting the grid plate to the thus constructed corona discharging device, the engagement portion shaped by an elastic protrusion has to be deformed beforehand, or, alternatively, the grid plate is required to be pulled inwards to the greatest possible degree. The attachement thereof is therefore quite troublesome. Besides, dismounting the grid plate involves operations reversed to the above, so that the troublesome situation is the same.

The second of the prior art corona discharging devices is attended with the following problems. It is difficult to insert the U-shaped spring member into the discharging body, resisting the resilient force thereof. Even if inserted, the spring member will probably spring out of the discharging body due to its resilient force. In addition, the configuration of the corona discharging device becomes intricate, and its assembly is also troublesome.

SUMMARY OF THE INVENTION

It is a primary object of the present invention to provide a corona discharging device capable of facilitating attachement and detachment of a grid plate with a simple construction.

According to the first aspect of the invention, there is provided a corona discharging device characterised by comprising: a discharging body; a corona wire stretched within the discharging body; and a control grid, formed at both of its ends with engaged portions, for covering at least a part of the corona wire, the corona discharging device including: engaging members engaging with the engaged portions of the control grid; and support members for supporting the engaging members, at least one of the support members being detachably attached to the discharging body by impinging, when being attached, an end of the support member on a side of the control grid upon a part of the discharging body and rotating the support member with the end thereof serving as a fulcrum, wherein there is further provided a lock means for locking, when mounting, one of the support members on the discharging body.

According to the second aspect of the invention, there is provided a corona discharging device characterised by comprising: a shield case; and end blocks formed with openings and provided at both ends of the shield case, the corona discharging device including: cover members detachably mounted on the end blocks to cover the openings; a corona wire stretched between the end blocks; and a control grid, formed at both of its ends with engaged portions, for covering at least a part of the corona wire, wherein at least one of engaging members engaging with the engaged portions is provided on the cover member, and at_least one of the engaging members is elastically deformable in a stretching direction of the control grid.

Other objects and advantages of the present invention will become apparent during the following description taken in conjunction with the accompanying drawings.

DETAILED DESCRIPTION OF THE INVENTION

Embodiments of the present invention hereinafter be described with reference to the accompanying drawings.

Figure 1:
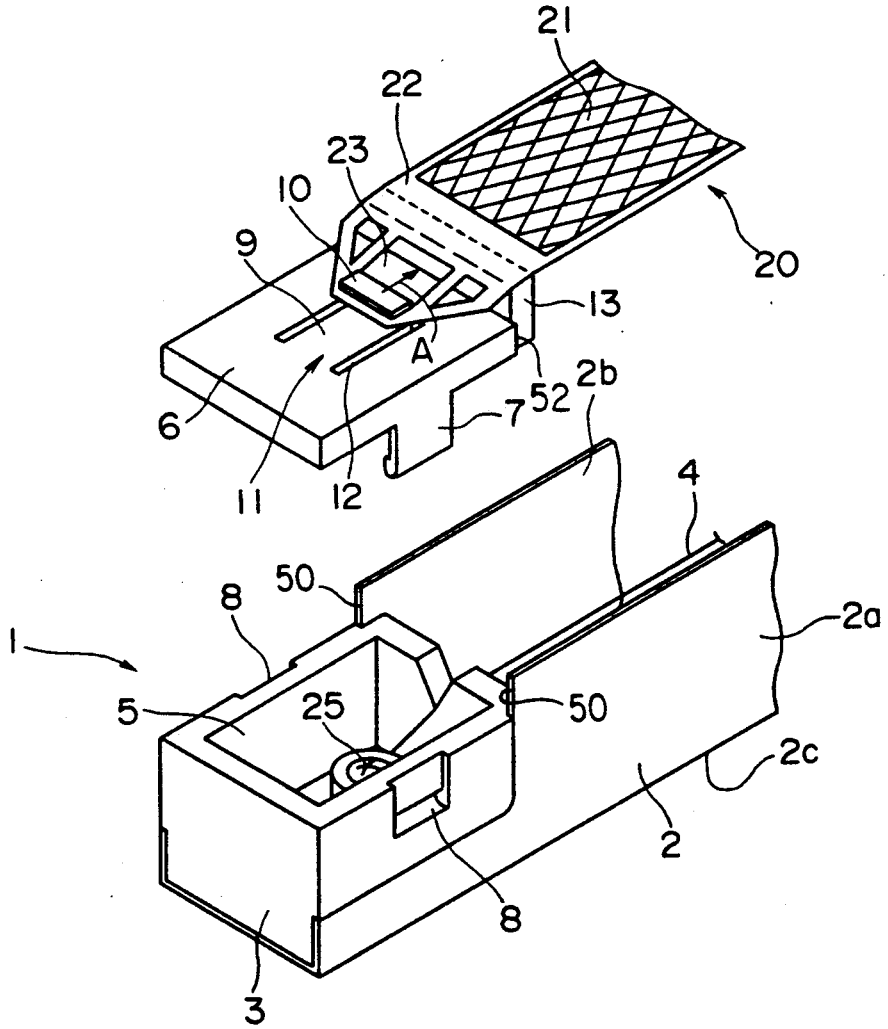
FIG. 1 is a partially exploded perspective view illustrating a corona discharging device is one specific example of the present invention.
Figure 2:
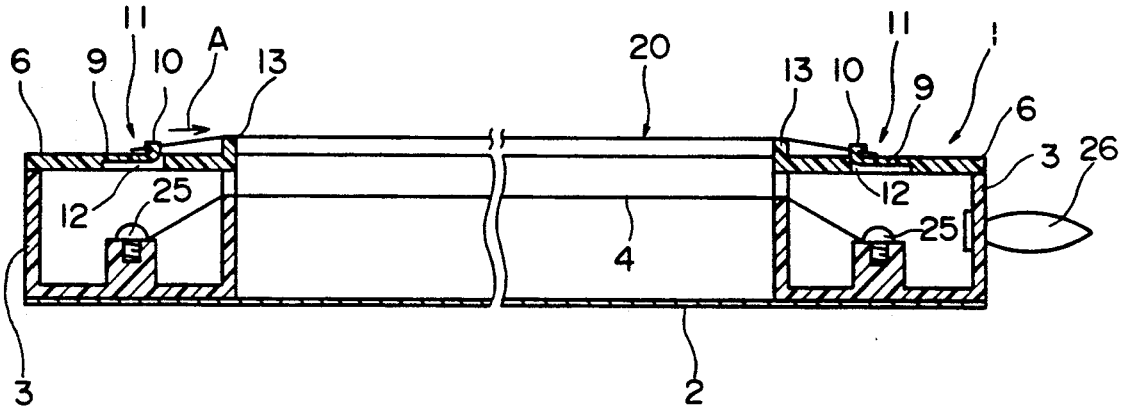
FIG. 2 is a sectional view showing a state of assembling the corona discharging device depicted in FIG. 1.

Turning first to FIGS. 1 and 2, the numeral 1 represents a corona discharging device composed chiefly of a shield case 2; end blocks 3; a corona wire 4; a cover 6 constituting a support member; and a grid plate 20 which shapes a control grid.

More specifically, the shield case 2 is formed of a conductive material to assume a substantially C-like configuration. Provided at both ends of the shield case 2 are the end blocks 3 each made of an insulating material which are combined with the shield case to constitute a discharging body. Stretched between the end blocks 3 is the corona wire 4 for electrifying a photosensitive body (not illustrated) with a predetermined tension by proper means like machine screws 25. The corona wire 4 is electrically connected to a connector terminal 26 provided on an end surface of one of the end blocks 3 by a known means. Formed in the end blocks 3 are openings 5 for performing screw-fastening when stretching the corona wire 4. Where a high voltage is impressed after inserting the corona discharging device 1 into a copying machine body with the openings 5 wearing no cover, an inconvenient situation like a leak takes place. For this reason, generally a cover 6 made of an insulating material is attached. The cover 6 is provided with a stopper 7 defined as a second engaging member, the stopper 7 protruding therefrom. The end block 3 corresponding thereto is formed with a notch 8 conceived as a second engaged portion. The stopper 7 is fitted in the notch 8, thereby engaging the cover 6 with the end block 3. A substantially central portion of the cover 6 is, as illustrated in FIGS. 1 and 2, provided with an engaging member 11 consisting of a base 9 having a thickness smaller than that of the cover 6 and of a hook-like portion 10 formed in continuation from the base 9. The hook-like portion 10 is relatively thin enough to be elastically deformed by a force acting in the direction of arrow A of FIG. 1 and FIG. 2. Through-holes 12 are perforated in the circumference of the base 9, thereby further facilitating the elastic deformation of the hook-like portion 10 of the engaging member 11. A height regulating member 13 for regulating a height of the grid plate is, as will be mentioned later, provided in continuation from an edge of the cover 6 on the side of a discharging region. Namely, the height regulating member 13 serves to keep a constant spacing between a surface of the photosensitive body and the grid plate.

The grid plate 20 consists mainly of a mesh 21 and a frame 22. Slits 23 serving as engaged portions are formed in both ends of the frame 22 in the longitudinal direction. The slit 23 is caught by the hook-like portion 10 of the engaging member 11, whereby the grid plate 20 is held by the cover 6. Both ends of the frame 22 in the longitudinal direction impinge upon the height regulating member 13, thereby regulating the height of the grid plate 20.

Based on the constitution of the foregoing embodiment, there will be explained an operation of mounting the grid plate on the corona discharging device body in which the corona wire is stretched with an adequate tension.

Figure 3:
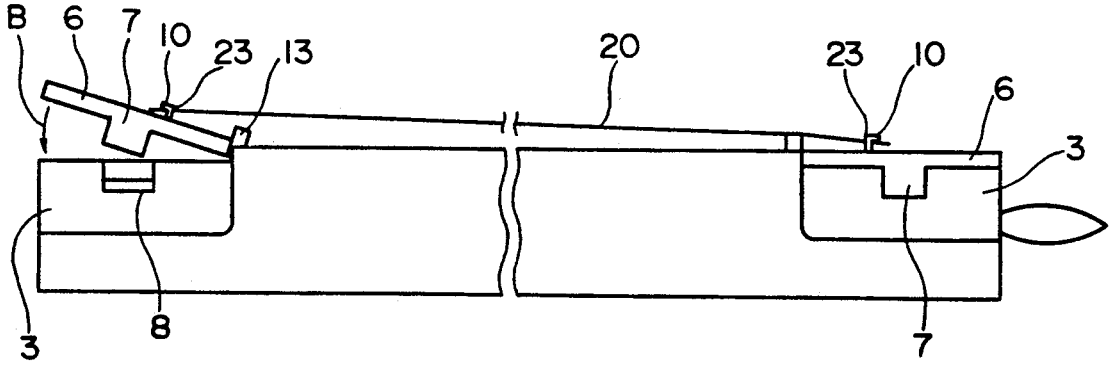
FIG. 3 is a side view illustrating a method of assembling the corona discharging device depicted in FIG. 2.

To start with, the cover 6 is mounted on the end block 3 depicted at an upper right portion in FIGS. 2 and 3 by engaging the stopper 7 provided on the cover 6 with the notch 8 formed in the end block 3. Subsequent to this step, the slit 23 formed at one end of the grid plate 20 is caught by the hook-like portion 10 of the engaging member 11 provided on the cover 6 attached to the right end block 3. The slit 23, formed in the other end of the grid plate 20, is caught by the hook-like portion 10 of the engaging member 11 provided on the other cover 6. At this time, the other cover 6 is not yet engaged with the end block 3 positioned to the left in FIGS. 2 and 3. Thereafter, the other cover 6 is attached to the end block 3 located to the left in FIG. 3. To be specific, as illustrated in FIG. 3, the end of the cover 6 on the side of the height regulating member 13 (on the side of the grid) is placed on the grid-side end of the left end block 3, while the other end of the cover 6 is set afloat above the end block 3. At this time, the grid plate 20 is retained with no slack between the two engaging portions. In this state, the two hook-like portions 10 of the two engaging members 11 are not yet elastically deformed. Subsequently, the cover 6 is rotated in the direction of arrow B to engage the stopper 7 thereof with the notch 8 of the end block 3 to assume a configuration depicted in FIG. 2, wherein a fulcrum is formed by the outwardly facing edge portions 50 of the shield case 2. Fulcrum surfaces are provided by the end 52 of the cover 6 on the side of the height regulating member 13. When turning the covers 6, the hook-like portions 10 and 10 of the engaging members 11 and 11 provided on the two covers 6 are elastically deformed in such a direction as to gradually narrow a spacing therebetween in accordance with a length of the grid plate 20. Eventually, as depicted in FIG. 2, the two hook-like portions 11 undergo the elastic deformation corresponding to the length of the grid plate 20, and the lower part of the frame 22 for the grid plate 20 impinges upon the two height regulating members 13, thus regulating the height of the grid plate 20. Simultaneously, the grid plate 20 can be stretch-retained with a proper tension.

On the occasion of periodic cleaning of the corona wire 4 and the interior of the shield case 2, or of replacement of the corona wire 4, it is desirable that the workability be improved by removing the grid plate 20. On that occasion, the reversed operations are performed. That is, the grid plate 20 can be removed simply by dismounting one cover 6 from the end block 3.

Another embodiment of the invention will be explained with reference to FIG. 4. A different arrangement of this embodiment from the preceding embodiment is that one engaging member is attached to the end block instead of the cover, and the other engaging member has no elasticity.

Figure 4:
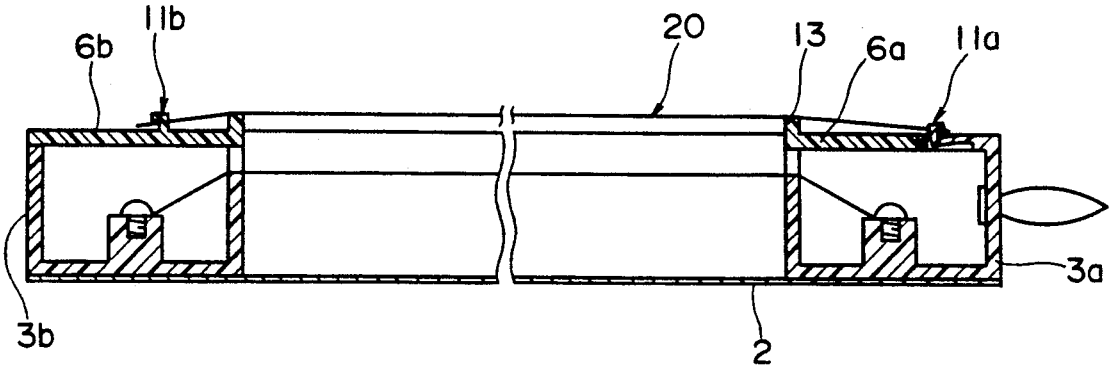
FIG. 4 is a sectional view illustrating the corona discharging device in another specific example of the invention.

More specifically, a cover **6*a* mounted on an end block 3*a* disposed to the right in FIG. 4 includes only the height regulating member 13 of the grid plate 20 but does not have any engaging member. In this embodiment, an engaging member 11*a* for holding one end of the grid plate 20 is provided on the end block 3*a* fixed to the shield case 2. A configuration of the engaging member 11*a* is identical with that shown in the previous embodiment, and the explanation is therefore omitted. The other cover 6*b* fitted to a left end block 3*b* is provided with an engaging member 11*b*** having no elasticity.

The description will next be focused on the operation of mounting the grid plate on the corona discharging device on the basis of the above-described construction. A slit formed in one end of the grid plate 20 has to be engaged with the engaging member **11*a* provided on the right end block 3*a*. The cover 6*b* is taken off from the left end block 3*b*, in which state a slit formed in the other end of the grid plate 20 is engaged with the engaging member 11*b*. Hence, there is no necessity for previously causing the elastic deformation of the engaging members or pulling the grid plate. Consequently, hooking can be made between the two engaging members. Thereafter, the other cover 6*b* is mounted on the end block 3*b*** in the same manner as that of the embodiment discussed above. In accordance with this embodiment, the grid plate can be stretched with an adequate tension, because one engaging member has the elasticity.

Figure 5:
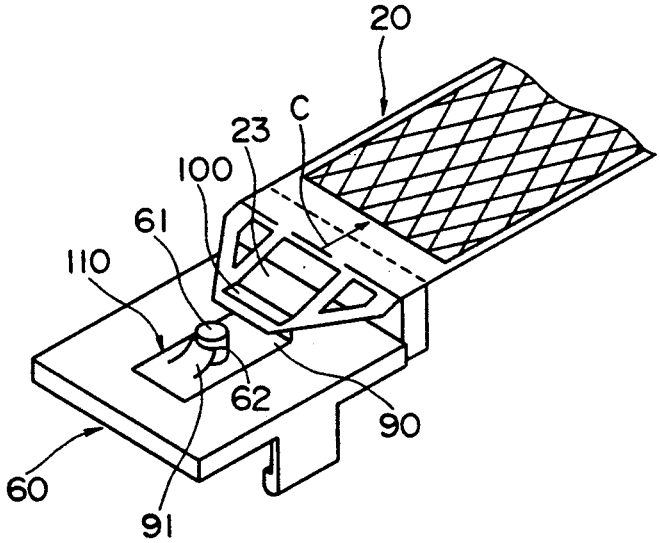
FIG. 5 is a perspective view showing a part of the corona discharging device in still another specific example of the invention.

Referring next to FIG. 5, there is shown still another embodiment of the engaging member according to the present invention. The above-described two embodiments adopt the arrangement that the engaging member is formed integrally with the cover or end block. Whereas in this embodiment, an engaging member separate from the cover is attached thereto.

An engaging member 110 in this embodiment involves the use of a leaf spring shaped by blending, e.g., a thin metal plate. Describing the configuration in greater detail, the engaging member 110 includes a hook portion 100 corresponding to the hook-like portion used in the previous embodiments and a base plate 90 corresponding to the base 9. The engaging member 110 is mounted on a cover 60 in the following manner. To begin with, the base plate 90 is notched to form a tongue piece 91. Subsequently, a pin 61 standing erect on the cover 60 is fitted into the notched portion of the base plate 90, in which case the tongue piece 91 impinges upon the pin 61 from the opposite side to the grid plate 20. The pin 61 is formed with a notch 62 into which the tip of the tongue piece 91 is inserted, thus preventing the engaging member 110 from coming off upwards in FIG. 5.

A slit 23, perforated in an end part of the grid plate 20, is caught by the hook 100 of the thus constructed engaging member 110. At this time, a tension is imparted to the grid plate 20 because of a spring property of the hook 100. Note that in this embodiment the tongue piece 91 also has a spring property adaptive more elastically to a pulling force acting in the direction of arrow C in FIG. 5.

In the embodiments discussed above, the shield case 2 is formed to assume a substantially C-like configuration in section, wherein the corona wire 4 is surrounded by three wall surfaces 2*a*, 2*b* and 2*c* in FIG. 1. However, the three wall surfaces are not necessarily provided. There may be adopted a combination of the wall surfaces 2*a* and 2*b*, or 2*a* and 2*c*; or one wall surface, e.g., 2*c* may suffice. In short, the configuration of the shield case may be properly selected to adapt itself to a copying machine.

There are offered process units for use with small-sized copying machines which have spread in recent years. This type of process unit is an image forming unit including a photosensitive body, an electrifying part, a developing part and a cleaning part. A casing for accommodating these components is typically formed of a resin. A shield case of the electrifying part and end blocks are shaped integrally with the resinous casing, and a conductive plate is installed on the rear surface opposite to a discharge opening formed in the side of the photosensitive body. The present invention can be applied even to the thus constructed process unit on condition that at least one end block is fitted with a cover for blocking the opening.

This embodiment has dealt with the arrangement that the height regulating member 13 of the grid plate is provided in continuation from the cover 6. The height regulating member 13 may be attached to the end block or formed integrally with this end block. A configuration of the height regulating member 13 can be varied as the case may be.

In the embodiments given in the description of the present invention, there are exemplified only two arrangements that wherein the covers are equipped with both of the engaging members, each exhibiting elasticity, and that one engaging member having elasticity is provided on a fixed body, while the other engaging member having no elasticity is attached to the cover. However, at least any one of the engaging members is mounted on an attachable/detachable support member like a cover and has elasticity. By utilizing such combinations, the present invention can be embodied. If a dimension between the engaged portions of the grid plate is virtually equalized to that between the two engaging members, it is permitted that the two engaging members do not have the elasticities. Even in this case, when mounting the support member, as illustrated in FIG. 3, on the corona discharging device with one end of the support member for supporting one engaging member serving as a fulcrum surface, the gird plate can readily be stretched between the engaging members.

Although the illustrative embodiments of the present invention have been described in detail with reference to the accompanying drawings, it is to be understood that the present invention is not limited to those embodiments. A variety of modifications or changes may be effected therein by one skilled in the art without departing from the scope or spirit of the invention.

What is claimed is:

1. A corona discharging device comprising:

a discharging body having an outwardly facing edge portion providing a fulcrum;

a corona wire stretched within said discharging body; and a control grid, formed at both ends with engageable portions, for covering at least part of said corona wire, said corona discharging device including:

engaging members for engaging with said engageable portions of said control grid, at least one of said engaging members being elastically deformable in a longitudinal direction defined by said control grid;

cover members, provided at end portions of said discharging body, for supporting said engaging members, at least one of said cover members having an outside end portion and an inside end portion which provides a fulcrum surface, and said at least one cover member being detachably attachable to said discharging body by impinging said fulcrum surface of said cover member with said fulcrum edge portion of said discharging body and rotating said cover member whereby said outside end portion of said cover member rotates about said inside end portion thereof in a direction toward said discharging body; and a locking means which locks when said at least one of said cover members is mounted on said discharging body.

2. The corona discharging device as set forth in claim 1, wherein said at least one engaging member is formed integrally with said cover member.

3. The corona discharging device as set forth in claim 1, wherein said at least one engaging member is a leaf spring member attached to said cover member.

4. The corona discharging device as set forth in claim 1, wherein said cover members each have a height regulating member for regulating a height of said control grid.

5. The corona discharging device as set forth in claim 1, wherein said locking means is composed of a second engaging member provided on said cover member, and a second engagable portion formed in said discharging body, and wherein said cover member is locked to said discharging body by engaging said second engaging member with said second engageable portion.

* * * * *